United States Patent [19]

Canaday

[11] 4,070,735

[45] Jan. 31, 1978

[54] SHOWER CURTAIN FASTENER

[76] Inventor: William Canaday, P.O. Box 1723, Plainville, Mass. 02762

[21] Appl. No.: 744,626

[22] Filed: Nov. 24, 1976

[51] Int. Cl.[2] ..... A44B 21/00; A47H 1/00

[52] U.S. Cl. ..... 24/73 VA; 24/204 R; 160/349 R; 160/DIG. 6; 248/206 A; 428/40

[58] Field of Search ..... 24/73 VA, DIG. 11, 73 PF; 248/206, 208 A; 160/DIG. 6, 349; 4/149; 292/DIG. 28; 428/40; 40/125 C

[56] References Cited

U.S. PATENT DOCUMENTS

| | | | |
|---|---|---|---|
| 2,227,541 | 1/1941 | Groff | 24/73 VA |
| 2,303,502 | 12/1942 | Rous | 160/DIG. 6 |
| 2,608,250 | 8/1952 | Meyer | 160/DIG. 6 |
| 2,642,248 | 6/1953 | Semon | 24/73 VA |
| 2,840,160 | 6/1958 | Tichenor | 160/DIG. 6 |
| 2,975,538 | 3/1961 | Murfin | 24/73 VA |
| 3,456,305 | 7/1969 | Voit | 24/205.16 D |
| 3,685,103 | 8/1972 | Severino | 24/205.16 D |

*Primary Examiner*—Bernard A. Gelak
*Attorney, Agent, or Firm*—Morse, Altman, Oates & Bello

[57] ABSTRACT

A shower curtain fastener with a short flexible strip formed with integral suction cups on one face and ridges and depressions on an opposite face. The ridges and depressions define an expanded surface area to which an adhesive layer is applied. A cover sheet with a release coating is superimposed on the adhesive layer.

10 Claims, 5 Drawing Figures

SHOWER CURTAIN FASTENER

BACKGROUND OF THE INVENTION

1. Field of Invention

The invention relates to fabric fasteners and, more particularly, is directed towards shower curtain fasteners.

2. Description of the Prior Art

Shower curtains as used in the customary manner with stall showers or bath tub showers are hung from a suitable height above the shower enclosure. The rush of water from the shower fixture causes agitation of the air which creates a draft that pulls the shower curtain into the enclosure. Such movement of the shower curtain is not only annoying to the bather but also allows water to spray out of the enclosure onto the floor.

SUMMARY OF THE INVENTION

It is an object of the invention to provide a fastener for holding a shower curtain in place and prevent the heretofore mentioned inconveniences. The fastener is in the form of a short flexible strip which is formed with suction cups on one face and ridges and depressions on an opposite face. The ridges and depression constitute an expanded surface area on which a self-sticking adhesive layer is applied. A cover sheet having a release coating is superimposed on the adhesive layer. In use, the cover sheet is removed and the adhesive layer is pressed against the margin of the shower curtain. The suction cups are then pressed against the sidewall of the shower enclosure for temporarily holding the shower curtain against the sidewall.

Other objects of the present invention will in part be obvious and will in part appear hereinafter.

The invention accordingly comprises the apparatuses and systems, together with their parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
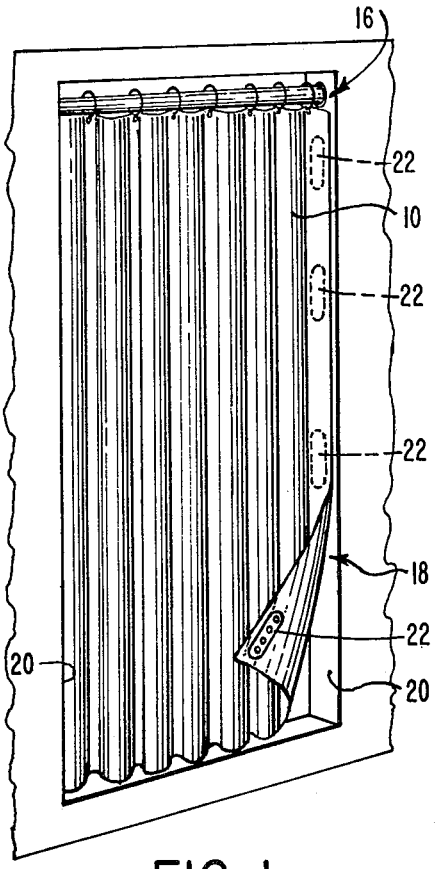
FIG. 1 is a perspective view of a doorway of a stall-type shower with a shower curtain having fasteners embodying the invention.

Referring now to the drawings, particularly FIG. 1, there is shown a flexible shower curtain 10 hung by hangers 12 from a horizontal top rod 14 which spans between opposite sides of an entrance 16 of a stall-type shower enclosure 18. Shower curtain 10 is held against sides 20 of enclosure 18 by a plurality of fasteners 22 which are attached to the vertical side margins of the shower curtain.

Figure 2:
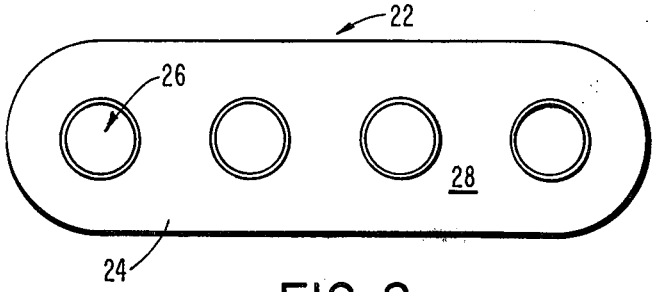
FIG. 2 is a plan view of one of the fasteners of FIG. 1.
Figure 3:
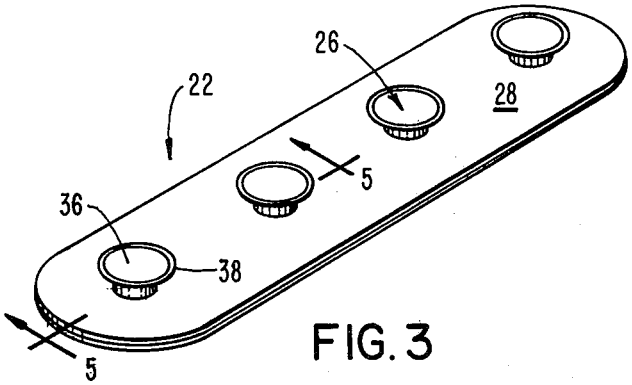
FIG. 3 is a perspective view of the fastener of FIG. 1.
Figure 4:
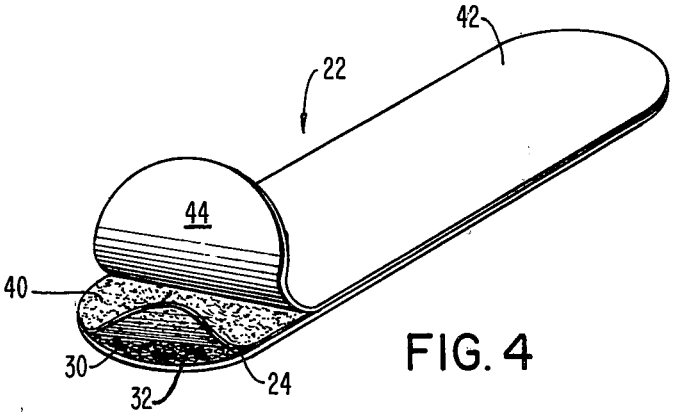
FIG. 4 is a perspective view of the fastener of FIG. 1 showing the adhesive layer and cover sheet.
Figure 5:
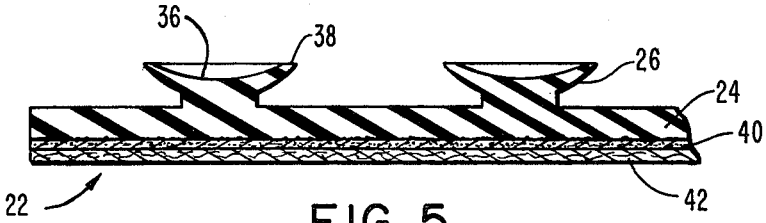
FIG. 5 is a sectional view taken along the lines 5—5 in FIG. 3.

As shown in FIGS. 2–4, each fastener 22 comprises a flexible strip 24 which is formed with integral suction cups 26 on an upper face 28 and a random pattern 30 of ridges and depressions on an opposite or lower face 32. Preferably, strip 24 is a molded member composed of an elastomer such as rubber. Strip 24, which has straight parallel sides and rounded ends, is approximately 10.5 cm in length, and 3.0 cm in width, and 1.0 mm thick. Each suction cup 26 is supported above face 28 on a pedestal 34 having a substantially circular profile in right cross section. Each suction cup includes a concave central portion 36 which terminates in an outer ring 38, an upper flat face of ring 38 disposed in a plane that is parallel to outer face 28. Suction cups 26 are coaxial with their respective pedestals 34 and are disposed equidistantly along a longitudinal axis of strip 24. The diameter of each suction cup 26 is approximately 1.0 cm, the suction cups being equally spaced apart from one another and equally spaced from the edges of strip 24. The overall height of each suction cup 26 is approximately 4.0 mm.

As best shown in FIG. 4, a pressure sensitive adhesive layer 40 is superimposed on lower face 32 and a protective cover sheet 42 having a release coating 44 is superimposed on the adhesive layer. The ridges and depressions of pattern 30 define an expanded surface area and are operative to form a woven web like pattern in adhesive layer 40. The peak to valley height of the ridges and depressions is in the range of 25 microns to 100 microns. In the illustrated embodiment, cover sheet 42 is a silicone impregnated paper release stratum that is approximately 50 microns thick, the profile of sheet 42 corresponding to the profile of strip 24. Pressure sensitive adhesive layer 40 is composed of an acrylic base resin and an elastomeric polyene tackifier, and ranges in thickness from 10 microns to 30 microns. A typical formulation of pressure sensitive layer 40 incorporates from 15 to 30 parts of a straight chain acrylate, particularly a co-polymer, homopolymer or interpolymer of methyl acrylate, ethyl acrylate, propyl acrylate or butyl acrylate, and from 2.5 to 7.5 parts of a low molecular weight rubber, particularly, a polyhydocarbon such as polybutene or polyterpene. In the illustrated embodiment, pressure sensitive layer 42 is a layer of methyl acrylate polybutene pressure sensitive adhesive. The tack of pressure sensitive adhesive layer 40 is more agressive with respect to lower face 30 than it is with respect to release coating 44.

In the use of fasteners 22, protective sheet 42 is removed from one of the fasteners, exposing the upper surface of adhesive layer 40. Then, fastener 22 is placed along the lower vertical margin of shower curtain 10, the edges of the fastener being parallel to the edge of the shower curtain. Next, fastener 22 is pressed against shower curtain 10, whereby pressure sensitive adhesive layer 40 adhers to the shower curtain. Next, protective sheet 42 is removed from another one of fasteners 22 and this fastener is attached to a lower medial portion of shower curtain 10 in the manner previously described. In the illustrated embodiment, four fasteners 22 are spaced along the margins of each vertical edge of shower curtain 10. The bather then enters shower enclosure 18 and presses suction cups 26 against sidewalls 20 for temporarily holding shower curtain 10 against the sidewalls. After showering, fasteners 22 are pulled individually from sidewall 20, releasing the vacuum grip of suction cups 26. The tack of adhesive layer 40 with respect to shower curtain 10 and lower face 32 of fastener 22 is more aggressive than the vacuum grip provided by suction cups 26.

Since certain changes may be made in the foregoing disclosure without departing from the scope of the invention herein involved, it is entended that all matter contained in the above description and depicted in the accompanying drawings be construed in an illustrative and not in a limiting sense.

What is claimed is:

1. A fastener for temporarily holding a flexible shower curtain against the sidewall of a shower enclosure, said fastener comprising:

(a) flexible strip formed with a plurality of integral suction cups on one face thereof;

(b) a pressure sensitive adhesive layer superimposed on an opposite face of said flexible strip, said opposite face of said flexible strip formed with an expanded surface area to which said adhesive layer is attached; and (c) a cover sheet having a release coating superimposed on said adhesive layer, said release coating in contact with said adhesive layer.

2. The fastener as claimed in claim 1 wherein each said suction cup includes a concave central portion which terminates in an outer ring, an upper flat face of each said ring disposed in a plane that is parallel to said one face of said flexible strip.

3. The fastener as claimed in claim 2 wherein each said suction cup is supported on a pedestal above said one face, said suction cups being equally spaced from the edges of the said flexible strip.

4. A fastener as claimed in claim 3 wherein said opposite face of said flexible strip is formed with a random pattern of ridges and depressions which forms a woven web like pattern in said adhesive layer, said ridges and depressions having a peak to valley height in the range of 25 microns to 100 microns.

5. A fastener as claimed in claim 4 w'.erein said flexible strip is formed with four suction cups on said one face and said expanded surface area is a random pattern of ridges and depressions on said opposite face, said ridges and depressions having a peak to valley height in the range of 25 microns to 100 microns.

6. The fastener as claimed in claim 5 wherein each said suction cup includes a concave central portion which terminates in an outer ring having a flat upper surface that is in a plane which is parallel to a plane of said flexible strip.

7. The fastener as claimed in claim 6 wherein said strip is composed of rubber.

8. The fastener as claimed in claim 7 wherein said cover sheet is a silicone impregnated paper release stratum.

9. The fastener as claimed in claim 8 wherein said adhesive layer has a tack which is more agressive with respect to said flexible strip and shower curtain than a gripping force of said suction cups against the sidewall of the shower enclosure.

10. The fastener as claimed in claim 9 wherein a pedestal supports each of said suction cups above said flexible strip, said pedestal, flexible strip and suction cups being an integral structure.

* * * * *